United States Patent [19]

Regan et al.

[11] 4,002,943

[45] Jan. 11, 1977

[54] TUNABLE MICROWAVE CAVITY

[75] Inventors: Robert J. Regan, Needam; Paul O. Haugsjaa, Acton, both of Mass.

[73] Assignee: GTE Laboratories Incorporated, Waltham, Mass.

[22] Filed: July 22, 1975

[21] Appl. No.: 598,089

[52] U.S. Cl. ..... 315/39; 315/39.53; 315/248; 333/33; 333/26; 333/84 R

[51] Int. Cl.[2] ..... H01J 7/46; H01J 19/80

[58] Field of Search ..... 315/39.53, 248; 333/26, 333/84, 33, 34

[56] References Cited

UNITED STATES PATENTS

| | | | |
|---|---|---|---|
| 3,085,199 | 4/1963 | Foss | 333/83 R X |
| 3,160,825 | 12/1964 | Derr | 333/83 R X |
| 3,324,425 | 6/1967 | Swartley | 333/83 R X |
| 3,605,041 | 9/1971 | Judkins | 333/83 R |
| 3,641,389 | 2/1972 | Leidigh | 315/39 |
| 3,688,219 | 8/1972 | Havens | 333/83 R |
| 3,697,893 | 10/1972 | Faustlin et al. | 333/83 R |
| 3,703,689 | 11/1972 | Mc Atee | 333/83 R |

*Primary Examiner*—Saxfield Chatmon, Jr.
*Attorney, Agent, or Firm*—Irving M. Kriegsman; Leslie J. Hart

[57] ABSTRACT

A tunable microwave cavity permits adjustment of the penetration of a power coupling probe into the main cavity by adjusting a grounded element of the cavity. A pair of conductive tubes are in telescoping relationship and have mutually engaging threads so that a rotation of one tube causes one tube to pass over the other. A first one of the tubes is mounted to the main cavity and around an aperture in the cavity wall. A power coupling connector is mounted with the second tube, and a rotating electrical contactor is disposed between the outer conductor of the connector and the second tube so that the connector does not rotate with the second tube. A power coupling probe affixed to the end of the inner conductor of the connector assumes various penetration depths within the main cavity in response to a rotation of the second tube. The cavity may be used in a light source including a high frequency power source and an electrodeless lamp disposed in the main cavity.

7 Claims, 4 Drawing Figures

FIG. 1
PRIOR ART
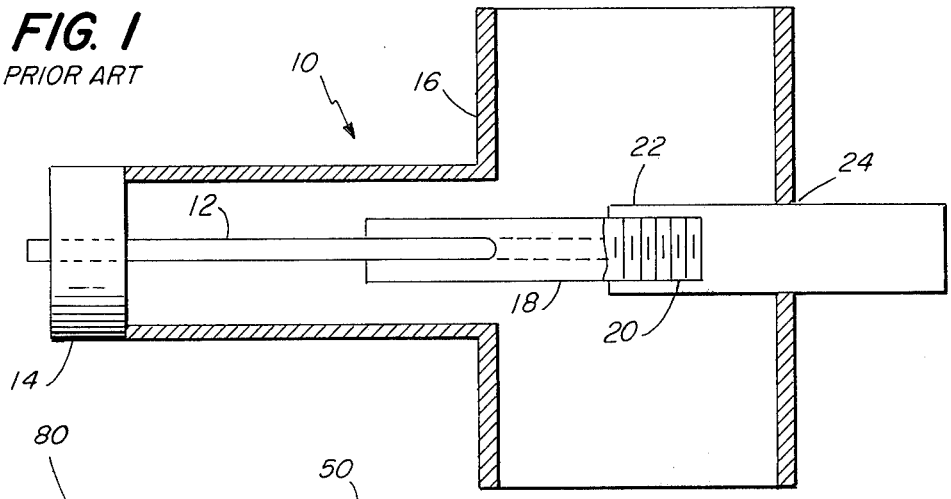
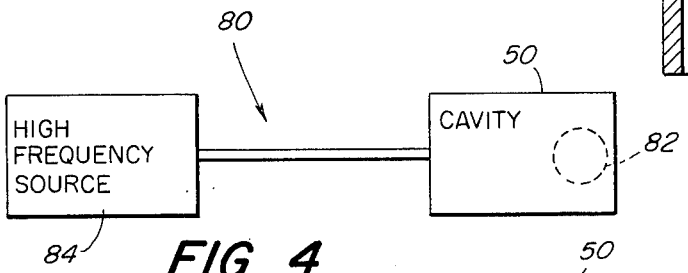
FIG. 4
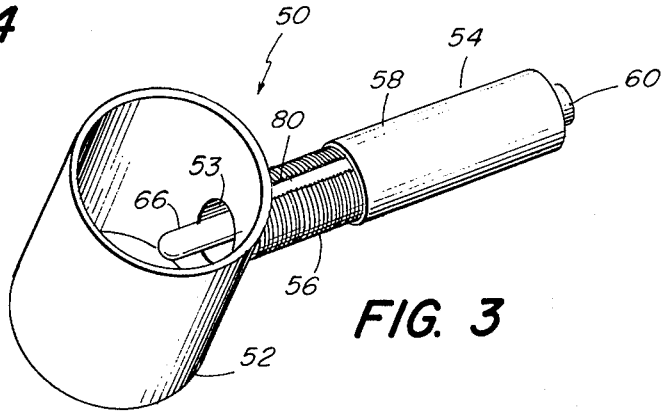
FIG. 3
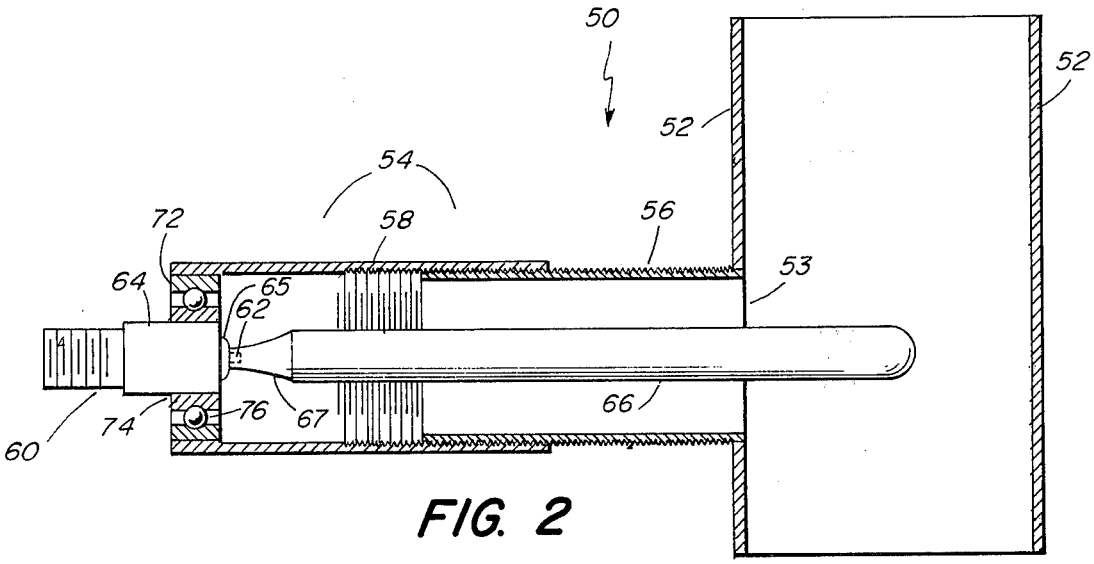
FIG. 2

TUNABLE MICROWAVE CAVITY

BACKGROUND OF THE INVENTION

The present invention relates to a microwave cavity and, more specifically, to a microwave cavity having a power coupling probe for optimizing the impedance match between the cavity and the source of microwave power.

Various types of adjustable microwave cavities are known in the prior art. Exampls of these may be found in the publication by Fehsenfeld et al entitled "Microwave Discharge Cavities Operating at 2450 $MH_z$", Review of Scientific Instruments, Vol. 36, No. 3, (March 1966). One cavity described therein is shown in FIG. 1 of the drawings herein and is known as an "Evanson Cavity" which is manufactured by the Opthos Manufacturing Company of Rockland, MD. In this cavity 10, the power coupling stub consists of a fixed brass probe 12 which extends from an input connector 14 to the wall 16 of the cavity. A brass tube 18 which is threaded at the outer end 20 is then attached to the probe 12 so as to make a sliding electrical contact with the fixed probe. This threaded end is screwed into an insulator 22, such as teflon or ceramic material, which protrudes through a hole 24 in the main cavity. Adjustment of the coupling probe penetration in this type of cavity is made by grasping the protruding insulator 22 and pulling or pushing so as to move the effective electrical probe tip along the diameter of the main cavity 16.

There are watts) disadvantages in this cavity which makes its use for some applications less than optimal. From the point of view of safety, it is not desirable to handle a coupling probe extension. A considerable amount of microwave power (100's of wats) is routinely applied to the cavity through the coupling probe and leakage can occur through the hole 24 for the insulating extension 22. Furthermore, the insulator 22 can become quite hot when the cavity contains an electrodeless discharge, and can not be handled without gloves. Another problem with this type of adjustable cavity is that the effective probe tip position is not readily obvious since it is screwed into the insulator. Therefore, probe penetration must be obtained by some kind of indirect measurement. Also, the effective diameter of the probe is some value between the diameter of the fixed probe 12 and that of the brass tube 18 depending upon their relative positions. This, of course, affects the characteristic impedance of the input arm since this impedance is dependant upon the ratio of the inner diameter of the outer conductor to the outer diameter of the inner conductor in a coaxial line. An additional disadvantage of this type of cavity is that the hole 24 is necessary in the wall of the main cavity 16 to allow adjustment of the probe depth. This coupling technique causes the field configuration within the cavity to be more complex and difficult to control, because the hole introduces a discontinuance in the wall of the cavity, and the probe extension introduces an unnecessary dielectric inside the cavity and a possible source of power loss.

SUMMARY OF THE INVENTION

It is an object of the present invention to provide a tunable microwave cavity in which the power coupling adjustment element is grounded so that the cavity is safe electrically and the adjustment element does not rise to such high temperatures.

It is an additional object of the present invention to provide a cavity which does not require an aperture in the wall of the cavity for the adjustment element so as to reduce power loss and field control problems.

It is still an additional object to provide a cavity in which discontinuities along the coupling probe are eliminated.

An additional object is to provide a cavity in which coupling probe penetration may be accurately determined and reproduced by calibration of the adjustment element span of movement.

The present invention contemplates the idea of adjusting the position of the entire input connector and a coupling probe which has a uniform shape and is affixed to the inner conductor of the connector and of performing this adjustment by a device which is electrically connected to the outer conductor of the connector rather than to the inner conductor. By this arrangement, the adjusting device may be grounded.

According to the invention, the tunable microwave cavity includes a main cavity having an aperture formed in the cavity wall, and an adjustable coupling probe assembly for power coupling and for adjusting probe penetration with the cavity. The probe assembly includes a first conductive tube affixed to the cavity and extending from the region of the aperture and a second conductive tube in movable telescoping relationship with the first tube. A power coupling assembly, having an inner and outer conductor, is mounted in the second tube so that the outer conductor conductively contacts the second tube. A coupling probe is affixed to the inner conductor and has a length such that the end of the probe may penetrate the main cavity in response to the telescoping effect of the conductive tubes. Thus, no additional cavity aperture is required for adjusting the probe penetration nor is any insulating material necessary since the adjusting device is not connected electrically to the coupling probe. This produces a less complex field configuration within the main cavity. Also, the uniform shape of the coupling probe provides a fairly constant characteristic impedance for this probe coupling assembly regardless of the probe penetration.

In a preferred form of the invention, the conductive tubes have mutually engaging threads so that the telescoping effect is allowed by rotating the second tube with respect to the first tube. A device is disposed between the outer conductor and the second tube for inhibiting rotation of the connector when the second tube is rotated while at the same time maintaining electrical contact therebetween. This feature permits accurate control of the probe penetration. Furthermore, the second tube preferably is larger than the first tube so as to receive the first tube during the telescoping action thereby permitting the second tube to have internal threads. This permits the external surface of the second tube to be without threads, which makes the handling of the tube during probe adjustment more convenient. Furthermore, a portion of the outer surface of the first tube may be calibrated to permit more accurate control of probe penetration.

BRIEF DESCRIPTION OF THE DRAWINGS

In the drawings:

FIG. 1 is a sectional view of a known adjustable microwave cavity;

FIG. 2 is a sectional view of an adjustable microwave cavity in accordance with the principles of the present invention;

FIG. 3 is a perspective view of the adjustable microwave cavity accordance to the present invention, and FIG. 4 is a block diagram of an electrodeless light source in which the cavity shown in FIGS. 2 and 3 may be used.

DESCRIPTION OF PREFERRED EMBODIMENTS

In an exemplary embodiment of the present invention, as illustrated in FIG. 2, there is provided an improved tunable microwave cavity, represented generally by the reference numeral 50. The tunable cavity includes a main cavity 52 having an aperture 53 formed in the wall thereof. An adjustable coupling probe assembly 54 is provided for coupling microwave power to the main cavity 52 and for adjusting the penetration of the probe within the aperture 53 of the cavity wall. The assembly 54 has a first conductive tube 56 being rigidly affixed to the cavity wall so as to surround the aperture 53 so that a channel is formed from the interior of the tube to the interior of the cavity 52. A second conductive tube 58 is in movable telescoping relationship with the first conductive tube 56. As used herein the term telescoping is intended to mean to slide or to otherwise pass one within another like the cylindrical sections of the hand telescope. As shown in FIG. 2, the conductive tubes have mutually engaging threads so that the telescoping effect occurs when the second tube 58 is rotated with respect to the first tube 56. The present invention would also contemplate having a telescoping effect by sliding the second tube 58 with respect to the first tube in which no threads would be required. A microwave power coupling assembly indicated generally by the reference numeral 60 includes an inner conductor 62 and an outer conductor 64. Preferably these conductors form a coaxial cable connector in which the outer conductor and the inner conductor are fixed with respect to each other. In accordance with the present invention, the outer conductor 64 is mounted within the outer end of the second tube 58 so as to conductively contact the second tube. A coupling probe 66 is affixed to the end of the inner conductor 62 and has a length such that the end of the probe may penetrate the main cavity in response to this telescoping effect of the conductive tubes.

An element 65, made of an insulating material such as teflon, is disposed around the inner conductor 62, near the end. The probe 66 is preferably tapered, a shown at 67, to provide a smooth transition between the smaller diameter of the inner conductor 62 and the larger diameter of the probe 66. In FIG. 2, the probe is a solid brass rod having 0.435 inch diameter by 5.75 inches length and a 10° taper. The end of the probe is formed with an aperture so that the probe may be press-fit over the end of the conductor 62. The probe is then soft soldered to the inner conductor 62.

The cavity preferably includes a device for inhibiting the rotation of the outer conductor 64 of the power coupling assembly in response to a rotation of the second conductive tube 58 and for maintaining electrical contact between the outer conductor and the second conductive tube. Preferably this means includes a rotating electrical contactor which has a conductive element 72 in contact with the second conductive tube 58, a conductive element 74 in contact with the outer conductor 64 and a bearing assembly 76 disposed between the elements 72 and 74. Preferably the conductive material from which the coupling probe, the main cavity wall, the tubes, and the rotating electrical contactor are made is brass. In operation the second tube 58 is grounded since it is in electrical contact with the outer conductor of the input power connector 60 which is in turn usually grounded back at the microwave power source (not shown).

Referring now to FIG. 3 there is shown a perspective view of the improved tunable microwave cavity. The cavity 50 preferably includes a means for calibrating the depth of the penetration of the probe 66. This preferably is accomplished by the provision of a slot 80 on the first conductive tube 56. Appropriate markings (not shown) may be inserted on this slot so that, in response to the rotation of the second conductive tube 58, the positioning of the coupling probe 66 may be accurately determined and reproduced.

The present invention has been found to be particularly useful in applications involving an electrodeless light source such a shown in the block diagram in FIG. 4. A light source 80 includes an electrodeless lamp 82, having a light transmitting envelope containing a volatile fill material which emits light upon excitation and vaporization, the cavity 50 shown in FIGS. 2 and 3, and a source of high frequency power 84. Preferably, the high frequency is in the range from 902 to 928 MHz which is within the microwave region. One suitable lamp 82 has a spherically shaped quartz envelope with a 15MM ID and a fill material comprising 9.1 mg. of mercury and 10 torr of argon. The lamp 82 is located in the main cavity 52 of the cavity 50 and may be supported in place therein by a tripod arrangement (not shown) made of quartz. The output of the source 84 is coupled to the power coupling assembly 60 of the cavity 50.

One important aspect of this light source is maintaining the proper impedance match between the power source and the lamp cavity combination so that maximum power is coupled to the lamp itself. The lamp impedance, however, changes depending upon the state of excitation, i.e. the span from starting to the operating state. Therefore, it is important to have an accurate and effective means for adjusting the cavity impedance via the probe position so as to maintain an impedance match between a constant impedance power source and a variable impedance electrodeless lamp.

The embodiments of the present invention are intended to be merely exemplary and those skilled in the art shall be able to make numerous variations and modifications of them without departing from the spirit of the present invention. For example, it is possible that the first conductive tube may receive the second conductive tube in which case the first conductive tube would have internal threads, the second conductive tube external threads. All such variations and modifications are intended to be included within the scope of the present invention as defined by the appended claims.

We claim:

1. A tunable microwave cavity including a. a main cavity having an aperture formed in the wall thereof, and b. an adjustable coupling probe assembly for coupling microwave power to the main cavity and for accurately adjusting the penetration of the probe within the aperture of the cavity wall, the assembly having i. a first conductive tube being rigidly affixed to the cavity wall so as to surround the aperture so that a channel is formed from the interior of the tube to the interior of the cavity, ii. a second conductive tube in movable telescoping relationship with the first conductive tube, the conductive tubes have mutually engaging threads so that the telescoping action occurs in response to rotating the second tube with respect to the first tube, the second tube having inner dimensions which are larger than the outer dimensions of the first tube so that the second tube is disposed over the outer end of the first tube and wherein the first and second tubes have external and internal mutually engaging threads respectively, iii. a microwave power coupling assembly having inner and outer conductors which are fixed with respect to each other, the outer conductor being mounted within the outer end of the second tube so as to conductively contact the second tube, iv. a coupling probe affixed to the end of the inner conductor and having a length such that the end of the probe may penetrate the main cavity in response to the telescoping effect of the conductive tubes and v. means for inhibiting a rotation of the power coupling assembly in response to a rotation of the second conductive tube and for maintaining electrical contact between the outer conductor of the power coupling assembly and the second conductive tube, the rotation inhibiting means including a bearing assembly disposed between the outer conductor and the second tube to permit rotation of the second tube without a corresponding rotation of the power coupling assembly.

2. The tunable microwave cavity according to claim 1 wherein the ratio of the dimensions in cross section of the coupling probe to the first tube are uniform over the telescoping range so that the characteristic impedance of the coupling probe assembly is constant.

3. The tunable microwave cavity according to claim 1 further including means for calibrating the telescoping tubes so that the coupling probe penetration may be determined accurately.

4. The tunable microwave assembly according to claim 1 wherein the tubes, the coupling probe and the main cavity wall are made of brass.

5. The tunable microwave cavity according to claim 1 further including means for grounding the second tube so that the adjustment of the microwave cavity is at the grounded side of the cavity.

6. A light source including:

a. a source of power at a high frequency, b. a tunable cavity coupled to the source and having, 1. a main cavity having an aperture formed in the wall thereof, and 2. an adjustable coupling probe assembly for coupling power to the main cavity and for accurately adjusting the penetration of the probe within the aperture of the cavity wall, the assembly having a. a first conductive tube being rigidly affixed to the cavity wall so as to surround the aperture so that a channel is formed from the interior of the tube to the interior of the cavity, b. a second conductive tube in movable telescoping relationship with the first conductive tube, the conductive tubes having mutually engaging threads so that the telescoping action occurs in response to rotating the second tube with respect to the first tube, the second tube having inner dimensions which are larger than the outer dimensions of the first tube so tht the second tube is disposed over the outer end of the first tube and wherein the first and second tubes have external and internal mutually engaging threads, respectively, c. a power coupling assembly having inner and outer conductors which are fixed with respect to each other, the outer conductor being mounted within the outer end of the second tube so as to conductively contact the second tube, d. a coupling probe affixed to the end of the inner conductor and having a length such that the end of the probe may penetrate the main cavity in response to the telescoping effect of the conductive tubes, e. means for inhibiting a rotation of the power coupling assembly in response to a rotation of the second conductive tube and for maintaining electrical contact between the outer conductor of the power coupling assembly and the second conductive tube, the rotation inhibiting means including a bearing assembly disposed between the outer conductor and the second tube to permit rotation of the second tube without a corresponding rotation of the power coupling assembly, and c. an electrodeless lamp positioned in the main cavity and having an envelope made of a light transmitting material and a volatile fill material disposed within the envelope, the fill material emitting light upon vaporization and excitation.

7. The light source according to claim 6 wherein the high frequency is in the range from 902 to 928 MHz.

* * * * *

UNITED STATES PATENT OFFICE

CERTIFICATE OF CORRECTION

Patent No. 4,002,943 Dated January 11, 1977

Inventor(s) Robert J. Regan et al.

It is certified that error appears in the above-identified patent and that said Letters Patent are hereby corrected as shown below:

Col. 1, line 32, delete "watts)";

Col. 1, line 36, "wats" should read --watts--;

Col. 3, line 50, "a" should read --as--.

Signed and Sealed this

*fifth* Day of *July 1977*

[SEAL]

*Attest:*

RUTH C. MASON
*Attesting Officer*

C. MARSHALL DANN
*Commissioner of Patents and Trademarks*